United States Patent [19]

Grear et al.

[11] 4,316,567

[45] Feb. 23, 1982

[54] TRACTOR FOR ENGAGING AND ADVANCING A WEB OF PAPER

[75] Inventors: Horace S. Grear, Mount Prospect; Theodore M. Leno, Arlington Heights, both of Ill.

[73] Assignee: Teletype Corporation, Skokie, Ill.

[21] Appl. No.: 141,821

[22] Filed: Apr. 21, 1980

[51] Int. Cl.[3] ..... G03B 1/30; G03B 1/34

[52] U.S. Cl. ..... 226/74; 226/87

[58] Field of Search ..... 226/74, 75, 76, 78, 226/52, 87, 170

[56] References Cited

U.S. PATENT DOCUMENTS

| | | | |
|---|---|---|---|
| 3,347,433 | 10/1967 | Bernard | 226/52 |
| 3,392,893 | 7/1968 | Bennett | 226/74 |
| 3,507,431 | 4/1970 | Hepp | 226/74 |
| 3,606,122 | 9/1971 | Brewster | 226/74 |
| 3,825,162 | 7/1974 | Hubbard | 226/74 |
| 4,194,660 | 3/1980 | Seitz | 226/74 |
| 4,199,091 | 4/1980 | Hubbard | 226/74 |
| 4,206,859 | 6/1980 | Plaza | 226/170 |

FOREIGN PATENT DOCUMENTS

| | | | |
|---|---|---|---|
| 1229552 | 7/1957 | Fed. Rep. of Germany | 226/74 |
| 230839 | 8/1925 | United Kingdom | 226/74 |

*Primary Examiner*—Edward J. McCarthy
*Attorney, Agent, or Firm*—W. K. Serp; J. C. Albrecht

[57] ABSTRACT

A tractor 10 is disclosed for engaging and advancing a web of paper 20 by engaging a series of holes 21 along an edge of the paper 20. The tractor 10 includes a pair of parallel side plates 12, 14 and an elongated guide member 32 defining a continuous guide track 34. The guide member 32 is positioned between the side plates 12, 14 so as to define a continuous guide channel 36 in cooperation with the guide plates 12, 14. The tractor 10 also includes a drive belt assembly 22 comprising a continuous belt 62 carrying a plurality of spaced drive members 38 adapted to engage the holes 21 along the edge of the paper 20. A drive sprocket 33 located at one end of the guide channel 36 engages the drive members 38. Each guide member 38 has a hemicylindrically shaped base 64 with a notch 66 therein, thereby defining two parallel edges 67 which ride along the guide track 34. Additionally, each drive member 38 includes a drive pin 80, the profile of the surface of the drive pin 80 has the shape of a segment of an involute.

8 Claims, 6 Drawing Figures

FIG. 3
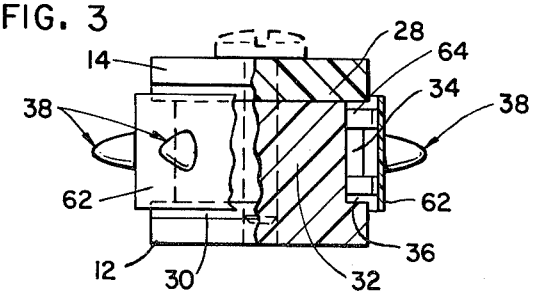
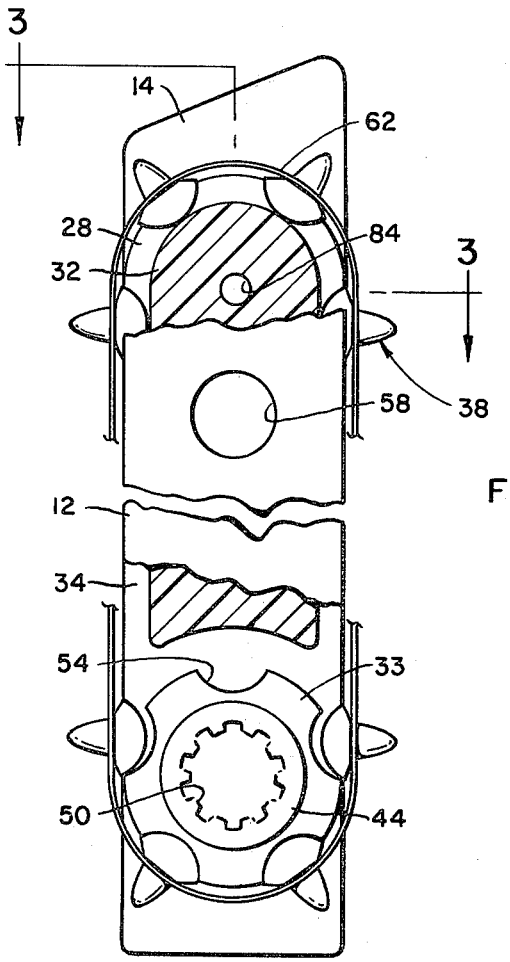
FIG. 2
FIG. 4
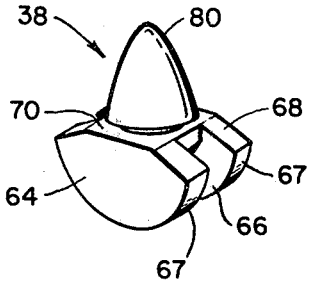
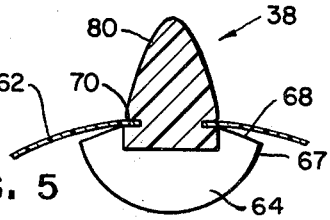
FIG. 5
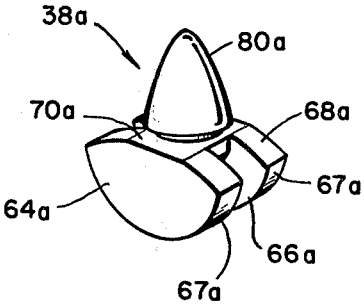
FIG. 6

TRACTOR FOR ENGAGING AND ADVANCING A WEB OF PAPER

DESCRIPTION

1. Technical Field

This invention relates to a tractor for engaging and advancing a web of paper by engaging a series of perforations along an edge of the paper.

2. Background Art

The tractor hereinafter described is particularly suitable for driving a continuous web of paper across a print station defined by a printer. One type of tractor used for driving a paper web is described in U.S. Pat. No. 3,825,162 issued July 23, 1974 to Leo J. Hubbard. As described in this patent, the tractor includes a pair of spaced, parallel oriented, generally rectangular side plates which define edges for supporting the edges of a continuous flexible belt carrying a plurality of spaced drive members which together form a belt drive assembly. Each of the drive members includes a circular drive pin having a circular profile at the tip which engages apertures along the margin of the paper. Additionally, each drive member includes a hemicylindrical base which is releasably engaged by a drive sprocket rotatably mounted between and at one end of the side plates. As taught by this reference, each hemicylindrical base defines a flat surface which is in direct contact with the belt. As the belt is drawn over the sprocket, the belt tends to form around the sprocket and in so doing is forced against the edges of the hemicylinder, causing a sharp bend in the belt. A similar belt distortion is experienced as the belt is drawn over the curved path defined at the opposite end of the tractor. Thus, the belt is constantly flexed by the sharp edges of the base as the drive members are engaged by the sprocket. During extended use, such belt flexing results in a weakening of the belt which eventually causes the belt to break or split around the location of the hemicylindrical base. Additionally, the support of the belt by the ledges defined by the side plates, produces wear on the belt as well as high frictional components resisting movement of the belt thus requiring a high level of rotational force by the motor driving the tractors. The device described hereinafter overcomes these disadvantages by greatly minimizing the flexing of the belt as it moves over the path defined by the tractor, as well as greatly reducing the frictional forces between the belt drive assembly and the frame of the tractor.

DISCLOSURE OF THE INVENTION

In accordance with this invention, a tractor is provided for engaging and advancing a sheet of paper across a print station of a printer. The paper has spaced holes along at least one edge thereof. The tractor includes a pair of generally planar side plates which are spacially and parallely positioned. An elongated guide member defines a continuous guide surface positioned between the side plates so as to define a guide channel in cooperation with the guide plates. The tractor includes a drive belt assembly comprising a continuous belt carrying a plurality of spaced drive members with the belt having a plurality of spaced openings with each of the drive members located at selected ones of the openings in the belt and adapted to engage the holes along the edge of the paper. A drive sprocket which defines a generally circular profile is rotatably positioned between the side plates and is located at one end of the elongated guide member. The surface of the sprocket is adapted to releasably engage the drive members so as to provide linear movement to the belt as the sprocket is rotated. The guide channel and the drive sprocket define a continuous path for the drive belt assembly. Each drive member has a substantially hemicylindrically shaped base with the longitudinal axis thereof oriented transverse to the direction of travel of the belt. The edges of the base oriented transverse to the path of movement of the belt are believed to allow the belt to conform to the curved contour of the sprocket and the guide channel as the base of the drive members are engaged by the sprocket.

More particularly, the curved surface of the base of each of the drive members defines a centrally located notch the axis of which is oriented along the longitudinal axis of the belt thus defining two curved, parallel, spacially positioned edges which ride along the guide track providing a low frictional coefficient between the drive members and the guide track. Additionally, each of the drive members includes an outwardly projecting drive pin for engaging the perforations along the edge of the paper. The surface of each drive pin has a profile the shape of a segment of an involute. The diameter of the base circle of the involute is approximately the diameter of the drive sprocket.

THE DRAWINGS

FIG. 2 is an enlarged full sectional view of the tractor of FIG. 1;

FIG. 3 is a half sectional view of the tractor of FIG. 1 along the line 3—3 of FIG. 2;

FIG. 4 is an enlarged perspective view of the drive member of the tractor of FIG. 1;

FIG. 5 is an enlarged half sectional plan view of the drive member of the tractor of FIG. 1; and FIG. 6 is an enlarged perspective view of an alternate embodiment of a drive member suitable for incorporation in the tractor of FIG. 1.

DETAILED DESCRIPTION

Figure 1:
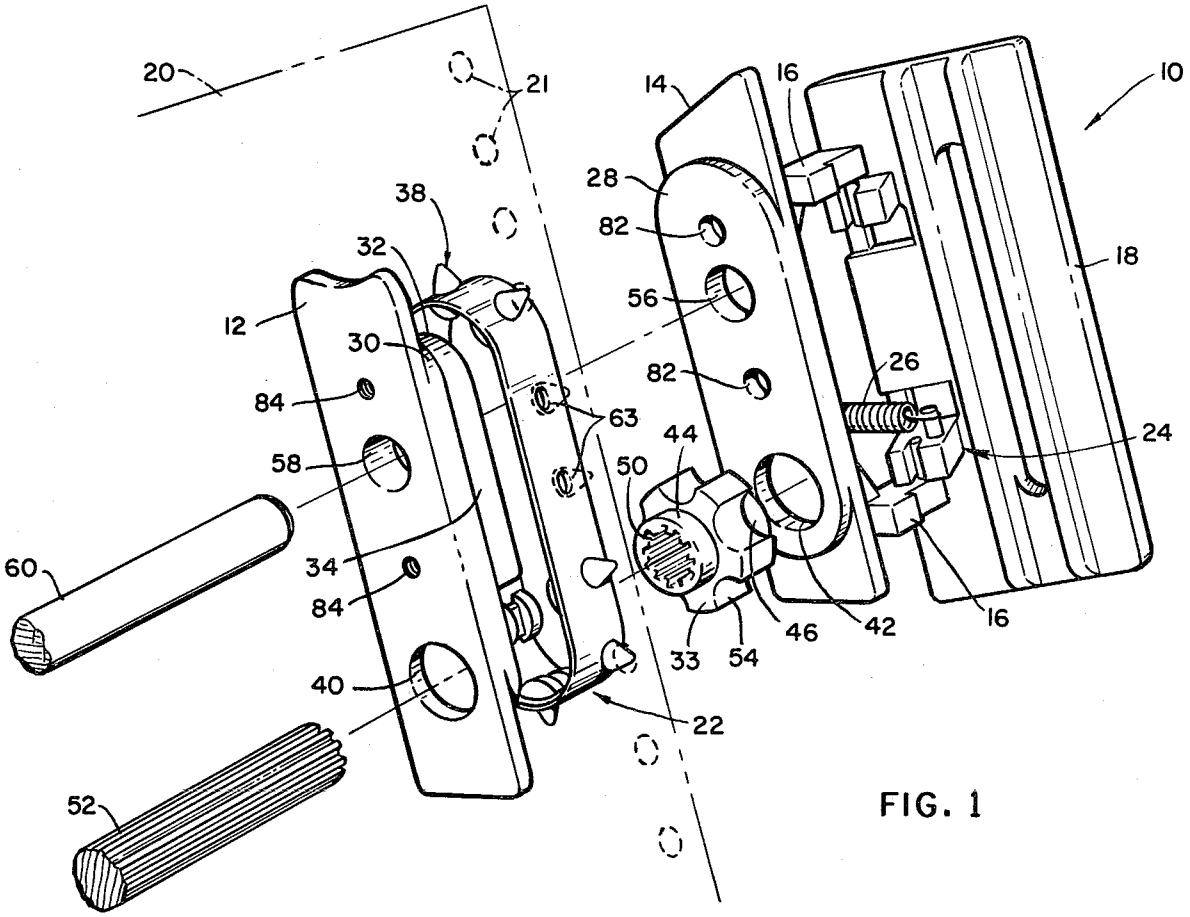
FIG. 1 is an exploded view of a tractor incorporating this invention.

With particular reference to FIG. 1, a tractor 10 includes a pair of generally flat, rectangular side plates 12 and 14. The side plate 14 has attached thereto, by means of a hinge assembly 16, a door 18, which, when closed, serves to maintain a continuous sheet of paper 20 having a series of spaced holes 21 along a margin thereof in engagement with a belt drive assembly 22. The door 18 may be positioned between two stable positions, that is, an open and a closed position. The alternate positions of the door 18 are maintained by an off-center toggle mechanism 24 including a coil spring 26 attached to the door 18 and the side plate 14. Projecting from side plate 14 is a raised segment 28 having the shape of an elongated oval. The opposing side plate 12 is of similar shape and also defines a raised segment 30 having an oval shape and a shoulder 32. As illustrated, one end of the shoulder is curved while the lower end as viewed in FIG. 2 is concave to provide clearance for a drive sprocket 33. The shoulder 32 defines an elongated guide track 34 which in combintion with the sprocket 33 defines a path along which the drive belt assembly 22 moves. The opposing surfaces of the raised segments 28 and 30 in cooperation with the guide track 34 define a guide channel 36 within which drive members 38 ride which form part of the drive belt assembly 22.

Each of the plates 12 and 14 respectively define enlarged holes 40 and 42 which are in alignment. Positioned within the holes 40 and 42 are hubs 44 and 46 of the drive sprocket 33. The holes 40 and 42 are slightly larger in diameter than the diameter of the hubs 44 and 46 of the sprocket 33 and the width of the sprocket 33 is slightly less than the width of the guide track 34 thus the drive sprocket 33 freely rotates between the plates 12 and 14. The drive sprocket 33 has a hole 50, the surface of which is fluted to receive a splined drive shaft 52 which is rotatably driven to the advance paper 20 through the tractor 10. The drive sprocket 33 has a maximum outer diameter which is greater than the width of the raised segments 28 and 30 defining the side walls of the guide channel 36. Additionally, equally spaced about the drive sprocket 33 are a plurality of recesses 54 having a shape slightly less than that of a hemicylinder. An imaginary circle tangentially connecting the bottoms of the recesses 54 would have a diameter approximately equal to the width of the shoulder 32. A pair of holes 56 and 58, respectively, in the side plates 12 and 14 are in registration and provide a second opening through the tractor 10 through which a support rod 60 passes. The drive shaft 52 and support rod 60 provide positional support for the tractor 10 when the tractor is mounted in an associated printer (not shown).

The drive belt assembly 22 includes a flat, endless belt 62 cut from a sheet of flexible material such as a polymide sold under the trademark Kapton by E. I. DuPont Corporation. The belt is punched with round holes 63 equally spaced along its entire length. At each hole 63 are located the drive members 38 which are formed on the belt by a plastic molding process. A suitable material for molding the drive members 38 is sold under the trademark Celcon by Celanese Corporation. The preferred embodiment of the drive member 38 includes a base 64 having a shape similar to that of a hemicylinder of a radius approximately the same as the radius of the recesses 54 of the sprocket 33. The curved surface of the base 64 serves to provide a low friction bearing surface with the guide track 34. The arrangement exhibits minimum surface contact between the drive member 38 and the guide track 34. The surface contact between the base 64 and the guide track 34 is further reduced by forming a notch 66 in the base 64. The longitudinal axis of the notch 66 is oriented transverse to the axis of the hemicylinder and along the longitudinal axis of the belt 62. This notch 66 not only reduces the total surface area of the base 64 which is in sliding contact with the guide track 34, but also reduces the amount of material necessary to mold the drive members 38 thus reducing manufacturing costs.

A unique feature of the drive member 38 is the relief displayed by the edges 67 of the base 64 which are parallel to the hemicylindrical axis. As shown in FIG. 4, the edges are chamfered as at 68. This form of edge relief prevents the belt 62 from being subjected to an abrupt bend as it is drawn over the drive sprocket and around the opposite curved end of the guide track 34. Thus, the belt 62 accommodates to the shape of the guide track 34 as it passes thereabout without being subjected to excessive stress. It should be noted that that portion of the base 64 adjacent the belt 62 remains substantially flat as at 70. This flat surface area 70 provided by the base 64, provides an extended contact area between the base 64 and the belt 62 and prevents rocking motion of the drive members 64 with respect to the belt 62 and possible drive member oscillations which could occur if the entire surface of the base 64 adjacent the belt 62 were arcuately shaped or crowned. German Pat. No. 1,229,552 entitled Vorrichtung für den Transport von randgelochten Stoffbahnen dated Dec. 1, 1966 issued to Rudolf Wanner, illustrates a drive member with a base having a circular shape and having rounded edges to allow the belt to accommodate a pair of drive and idler sprockets. This arrangement allows the drive members to rock with respect to the belt thus resulting in belt stress and possible cracking of the belt. The hemicylindrical shape of the base 64 of the drive members 38, provides a flattened support surface which extends substantially across the entire width of the belt 62. Thus, as the base 64 of the drive members 38 are drawn along the guide channel, the drive members 38 provide transverse support to the belt 62 over a relatively large area greatly reducing flexure and vibration of the belt 62. The device disclosed in the German reference provides no such transverse support. This feature of the illustrated embodiment, greatly reduces flexure and vibration of the belt 62 and thus results in extended belt 62 life. Additionally, the width of the base of the drive member 64 is closely fitted to the width of the guide channel 34 thus minimizing transverse movement of the belt 62 as it is drawn along the guide channel 36. The drive members described in the German reference do not include such a feature.

Still another feature of the illustrated drive member 38 is the shape of the surface of the drive pin 80 which engages the holes 21 along the edges of the paper 20. As clearly illustrated in FIG. 5, the surface of the pin 80 generally conforms to an involute profile. An involute profile is a profile developed by a point on a taut cord wrapped around one half of a base circle as the cord is unwound from the circle. A more detailed description of such a profile is described at pages 363 and 364 in *Machine Design,* by Irving J. Levinson, published by Reston Publishing Company, Inc., in 1978. In the illustrated embodiment, the base circle of the involute profile of the pin 80 has a diameter approximately equal to the maximum diameter of the drive sprocket 33. This involute profile is utilized since it allows the surfaces of the pins 80 to roll in and out of engagement with the paper with a minimum of sliding friction and thus a minimum of paper distortion and stress to the belt assembly.

With reference to FIG. 6, an alternate embodiment of the drive member 38 is illustrated with similar portions having the same reference numeral and the subscript "a". The longitudinal edges of base **64*a* of the drive member 38*a* are rounded along a radius substantially equal to the radius of the diameter of the drive sprocket 33**.

During assembly, the drive sprocket 33 is positioned with one hub 44 thereof seated into the opening 40 defined by the side plate 12. The drive belt assembly 22 is placed about the guide track 34 defined by the shoulder 32 with the hemicylindrical base members 38 resting on the guide track 34 and resting in the recesses 54 defined by the drive sprocket 33. The remaining side plate 14 is positioned with the remaining hub 46 of the drive sprocket 33 seated into the opening 42 of the side plate 14. The assembly is secured together by suitable screws inserted through holes 82 and threaded into tapped holes 84 in the side plate 12. This results in a rigid unitary construction. As the drive sprocket 33 is rotatably driven by the splined drive shaft 52, the drive belt assembly 22 is advanced about the guide channel 36 with the rotating drive sprocket 33 imparting movement to the drive belt assembly 38.

Although the invention has been particularly shown and described with reference to a preferred embodiment thereof, it will be understood that various changes in form and detail may be made without departing from the scope and spirit of the invention as defined by the following claims.

What is claimed is:

1. A tractor 10 for engaging and advancing a paper web 20 across the print station of a printer, said paper web 20 having spaced holes 21 along at least one edge thereof, said tractor 10 including a pair of generally planar side plates 12, 14 being spacially and parallely positioned, an elongated guide shoulder 32 defining a continuous guide surface 34 positioned between said side plates 12, 14 so as to define a guide channel 36 in cooperation with said guide plates 12, 14, a drive belt assembly 22 including a continuous belt 62 carrying a plurality of spaced drive members 38, said belt 62 having a plurality of spaced holes 63 with each of said drive members 38 located at selected ones of the holes on said belt 62 and adapted to engage the holes 21 along the edge of said paper web 20, a drive sprocket 33 defining a generally circular shape and rotatably positioned between said side plates 12, 14 and located at one end of said elongated shoulder 32, the surface of said drive sprocket 33 being adapted to releasably engage said drive members 38 so as to provide linear movement to the belt 62 as the drive sprocket 33 is rotated, said guide channel 36 and said drive sprocket 33 defining a continuous path for said drive belt assembly 22, CHARACTERIZED BY:

each of said drive members 38 having a substantially hemicylindrically shaped base 64, the longitudinal axis of the base 64 is oriented transverse to the direction of travel of the belt 62, the longitudinal edges of said hemicylindrical base 64 being relieved **68, 68*a* to allow the belt 62 to conform to the curved contour of the drive sprocket 33 and the guide channel 36 as the base 64 of the drive members 38 are engaged by the drive sprocket 33 and the drive belt assembly 22 is thereby moved along the guide channel 36**.

2. The tractor 10 of claim 1 further CHARACTERIZED BY:

the curved surface of said hemicylindrical base 64 of said drive members 38 defines a centrally located notch 66 the longitudinal axis of the notch 66 being oriented along the longitudinal axis of the belt 62 thereby defining two curved, parallel, spacially positioned edges 67 which ride along said guide track 34 providing a low frictional coefficient between the drive members 38 and said guide track 34.

3. The tractor 10 of claim 2 further CHARACTERIZED BY:

each of said drive members 38 includes an outwardly projecting drive pin 80 for engaging the perforations along the edge of the paper 20, the profile of the surface of the drive pin 80 has the shape of a segment of an involute, the diameter of the base circle of the involute being approximately equal to the outer diameter of said drive sprocket 33.

4. The tractor 10 of claim 1 further CHARACTERIZED BY:

said relief 68 of the longitudinal edges of said base 64 being chamfered with the surface 70 of said base 64 adjacent said belt 62 being relatively flat, thereby reducing the possibility of relative movement between said drive members 38 and said belt 62.

5. The tractor 10 of claim 1 further CHARACTERIZED BY:

said relief **68*a* of the longitudinal edges of said base 64 being formed by rounding the edges along a radius approximately that of the radius of the diameter of said drive sprocket 33**.

6. The tractor 10 of claim 2 further CHARACTERIZED BY:

said relief 68 of the longitudinal edges of said base 64 being chamfered, so that the surface 70 of said base 64 adjacent said drie pin 80 is relatively flat thereby reducing the possibility of relative movement between said drive members 38 and said belt 62.

7. The tractor 10 of claim 2 further CHARACTERIZED BY:

said relief **68*a* on the longitudinal edges of said base 64 being formed by rounding the edges along a radius approximately that of the radius of said drive sprocket 33**.

8. The tractor 10 of claim 6 further CHARACTERIZED BY:

each of said drive members 38 has an outwardly projecting drive pin 80 for engaging the holes 21 in the paper 20, the profile of the surface of the drive pins 80 having the shape of a segment of an involute, the diameter of the base circle of the involute being approximately the diameter of said drive sprocket 33.

* * * * *